United States Patent [19]

Hsiao

[11] Patent Number: 4,535,391

[45] Date of Patent: Aug. 13, 1985

[54] PORTABLE EMERGENCY LIGHT

[76] Inventor: Meng-Chang Hsiao, No. 61-1, Fu-Te St., Sung-Shan Dist., Taipei, R.O.C., Taiwan

[21] Appl. No.: 632,886

[22] Filed: Jul. 20, 1984

[51] Int. Cl.[3] ..... F21L 7/00

[52] U.S. Cl. ..... 362/183; 362/105; 362/184; 362/190; 362/191; 362/200; 362/208; 362/250; 362/251; 362/285; 362/295; 362/362; 362/396; 362/398; 362/399

[58] Field of Search ..... 362/105, 183, 184, 190, 362/191, 200, 208, 250, 251, 285, 295, 362, 396, 398, 399

[56] References Cited

U.S. PATENT DOCUMENTS 3,125,300 3/1964 Roche ..... 362/20

*Primary Examiner*—Stephen J. Lechert, Jr.

*Attorney, Agent, or Firm*—Cushman, Darby & Cushman

[57] ABSTRACT

A portable emergency light comprising two lamps at slopes on two lateral sides with the slope design to lower their height and space requirement, connection means consisting of slipper and slotted block between each lamp and light body, so that the lamps is detachable for moving to any other area for lighting purpose; controllers for lighting, extinguishing or flickering each respective lamps for lighting or warning purpose to add function of the emergency light and a plug on its holder to connect rectified and voltage reduced power source to the emergency light while it is positioned on the holder and the emergency light is disconnected from the said power source by applies its own built-in battery after it is detached from the holder.

4 Claims, 5 Drawing Figures

PORTABLE EMERGENCY LIGHT

BACKGROUND OF THE INVENTION

The invention relates to a lighting fixture, particularly an emergency light for lighting at power failure with portable structure and design for versatile purposes.

Generally a conventional automatic emergency light is fixed at its holder without portable structure. Normally it has two lamps permanently fixed to the light fixture. Thus neither of the lamps may be removed for lighting at some other direction. Therefore, its application and function are limited.

SUMMARY OF THE INVENTION

The present invention has a power source plug or socket which is connected to a direct current power source from rectification and voltage reduction of alternating current power to be inserted into a socket or plug on the emergency light while it is placing on the holder for automatic lighting at power failure, and the present invention applied its own built-in battery as power source after it is detached from the holder. Thus, while it is used as a portable light, it is safe since it does not connect to any high voltage power.

The lamps of the present invention are of detachable design which can be moved to any other particular position for lighting purpose. Its function will not be limited by any obstruction.

The present invention has lamp lowering means to minimize space requirements of the lamps and to minimize packaging material and volume for shipment.

The present invention is further characterized by the control of flickering or lighting of each individual lamp for transmitting and emergency signal. For instance, a lamp can be used as a warning signal while the other lamp is used for lighting in repairing or servicing a car.

DESCRIPTION OF PREFERRED EMBODIMENTS

Figure 1:
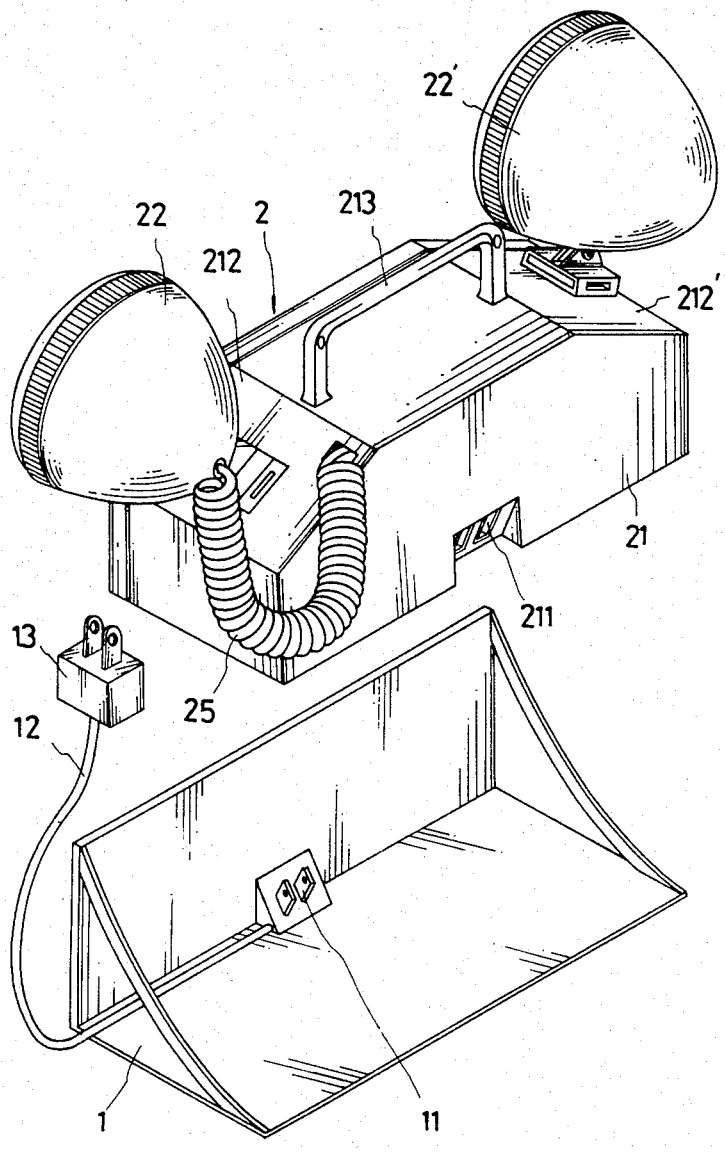
FIG. 1 is a perspective view of the back and holder of a portable emergency light, a preferred embodiment of the present invention.

Plase refer to FIG. 1. The holder (1) has a fixed plug (11) which is connected to a voltage reducing rectifier (13) via a connecting line (12) and then connected to an alternating current power source.

There is a socket (211) on the back of light unit (2) so that once the light unit (2) is positioned on the holder (1), the plug (11) can be inserted into the socket (211) for to connect the power to be applied for lighting during power failure.

The invention applies rectified power from a general power source after voltage reducing for lighting during power failure but its built-in battery when it is used as a portable lighting unit. High voltage and low voltage are applied respectively for safety purpose.

Power source can be connected once the plug (11) is inserted into the socket (211) during placing the light unit (2) within the holder (1). The power source can be disconnected by just removing the light unit (2) from the holder. No additional wiring to the light unit (2) is required. Its application is very simple.

Figure 2:
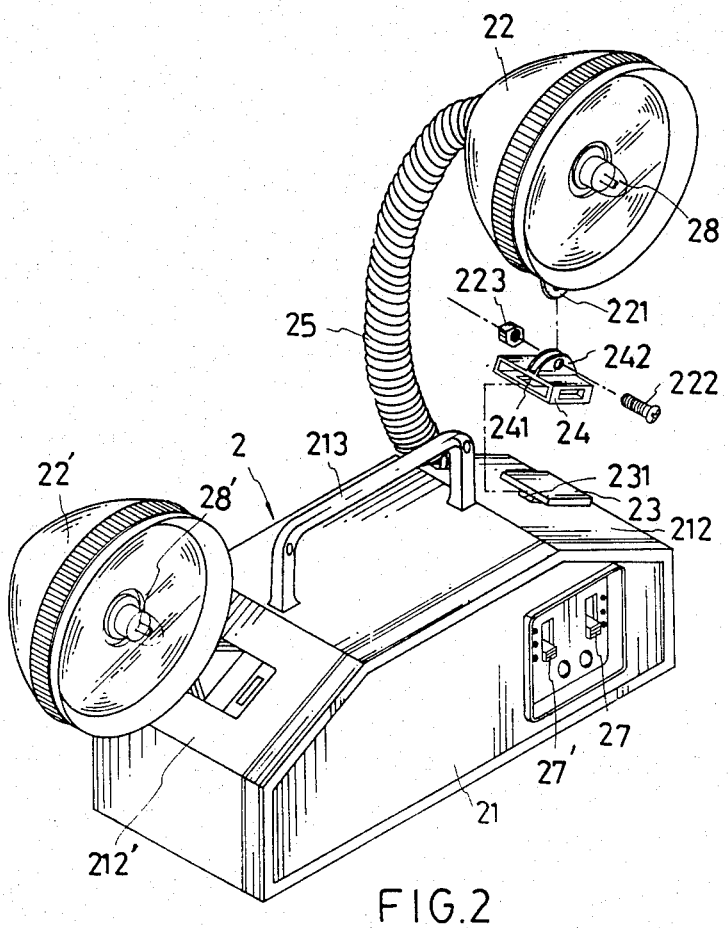
FIG. 2 is a fragmented drawing of a portable emergency light, a preferred embodiment of the present invention.

Please refer to FIG. 2. The light unit (2) has two major parts: body (21) and lamps (22, 22'). Just like the conventional emergency light, the body (21) has built-in battery, charger, relay, etc. Since it is not a feature of the present invention, description of which is omitted herein.

The lamps (22,22') of the embodiment of the present invention are mounted on two respective slippers (23) fixed to the slopes (212) at both lateral sides of the body (21). There is a slotted block (24) connected to the bottom of each lamp (22) so that the slot (241) under the slotted block (24) can be slipped onto a fixing block (231) beneath the slipper (23) for connecting the lamp (22) to the slipper (23), and removal of the sloteed block (24) from the slipper (23) will detach the lamp (22) from the slipper (23). Please refer to the FIG. 3 for attachment and the FIG. 5 for detachment.

Please refer to the FIG. 2 Between the lamp (22) and the slotted block (24) there is an ear (221) beneath the lamp (22) for inserting into a slot between the top flanges (242) on the slotted block (24). By a screw (222) passing the ear (221) and flanges and locked by a nut (223), the lamp (22) is attached to the slotted block (24) and thus its is turnable with the screw (222) as its axle.

There is an extending cord (25) between the lamp (22) and the body (21) so that the lamp (22) can be extended to another place for lighting purpose after the lamp (22) is detached from the body (21).

The arrangement of another lamp (22') on another lateral slope (212') on the body (21) is identical to the above description and it is not necessary to repeat here. In application of the present invention, we may usually leave a lamp (22') on the body (21) while another lamp (22) is extended to some other place.

Figure 3:
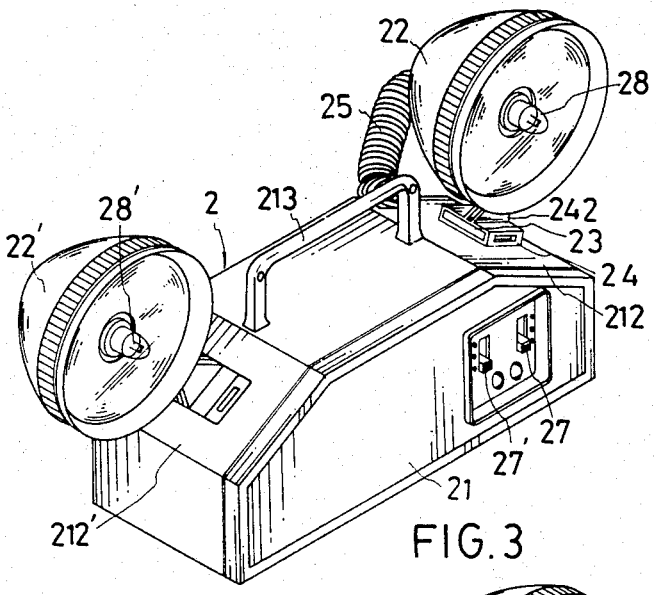
FIG. 3 is a perspective view of a portable emergency light, a preferred embodiment of the present invention.

FIG. 3 is a perspective view of the light unit (2), an embodiment of the present invention. As shown, lamp lowering means are provided to minimize space requirements for the lamps (22,22') in order to minimize the packaging material and packing volume requirements in shipment. These objects are mainly achieved by the design of slopes (212, 212') on both lateral sides of the top surface of the body (21). The slops (211, 211') are equipped for the attachment of slippers (23). Slippers (23) are used to fix the slotted blocks (24) beneath the lamps (22, 22'). Of course, recessions can be designed instead of slopes.

As shown in the FIG. 3, the handle (213) in the top surface of the body is for facilitating energency light carrying. There are two holes on the handle (213) for attaching carrying strap.

Furthermore, lamp flickering controller (e.g., flip-flop circuit) is installed within the body (21). Switches (27, 27') are installed at the panel for respectively controlling the bulbs (28, 28') in the lamps (22, 22'). By operating the switches (27, 27') the bulbs (28, 28') can be controlled for lighting, extinguishing or flickering individually or jointly.

Figure 4:
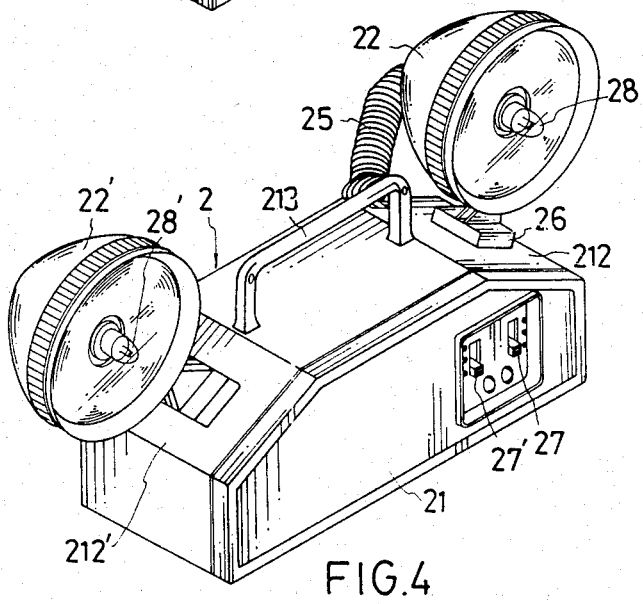
FIG. 4 is a perspective view of another preferred embodiment of the present invention.

FIG. 4 illustrates another embodiment for the connection between the lamp (22) and the body (21). A magnet (26) is fixed to the bottom of the lamp (22) to replace the aforesaid slotted block (24) so that the lamp can be attached to the metal body (21) directly by magnetic attraction.

Figure 5:
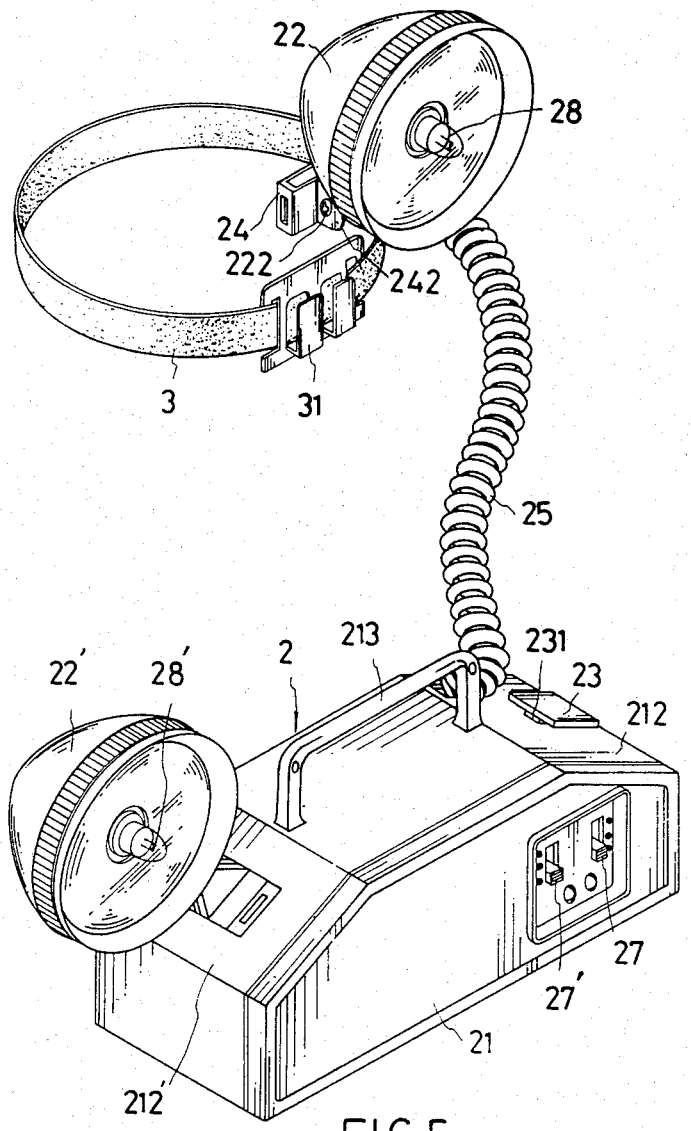
FIG. 5 is showing an embodiment of the present invention with a lamp detached from the body and there is a belt and a fastener below the lamp for using as a head light.

FIG. 5 shows the present invention with a detached lamp (22) for lighting purpose at some remote place and the lamp (22) has a belt (3) and fastener (31) beneath it, which, after attaching to the slotted block (24), can be fastened to one's head as a head light.

I claim:

1. A portable emergency light which can be used as a stationary emergency light while it is fixed at a place and as a portable light after removing it from its fixed place comprising:

a light housing at least two lamps wherein at least one lamp has an extension cord which can be detached from the light housing;

lamp lowering means for minimizing the space requirements of the lamps; and a flickering controller for said lamps and switches which control each said lamp for lighting, extinguishing or flickering respectively a said lamp.

2. A portable emergency light according to claim 1, wherein a said lamp is attached to said housing with a permanent magnet fixed to the bottom of a said lamp.

3. A portable emergency light according to claim 1, wherein said light further comprises:

a recharging holder configured to receive said light housing, said holder having a power socket, said housing having a socket configured to mate with said power socket, said housing having rechargable batteries therein, whereby when said housing is positioned in said recharging holder said power socket is mated with said socket and said batteries are recharged.

4. A portable light source comprising:

a housing, said housing having front and back walls, said housing having a pair of side walls, said housing having a top and a bottom, said top having a first central top portion parallel to said bottom, a second portion and a third top portion connected to said first portion, said second portion and said third portion sloping from the boundary with said first portion downwardly to a respective side wall;

a slipper member positioned on said second portion and a slipper member positioned on said third portion;

two lamps;

a means for releasably interconnecting a said slipper member and a said lamp;

an electrical power source within said housing, said electrical power source including a rectification circuit, switches, a lamp flickering controller, and a rechargable battery; and circuit means for electrically connecting said lamps to said electrical power source.

* * * * *